US005423689A

United States Patent [19]

Valentino

[11] Patent Number: 5,423,689

[45] Date of Patent: Jun. 13, 1995

[54] SAFETY SHHIELD FOR AN ELECTRIC PLUG

[76] Inventor: George Valentino, 2667 Rockaway Ave., Oceanside, N.Y. 11572

[21] Appl. No.: 84,698

[22] Filed: Jun. 29, 1993

[51] Int. Cl.[6] ..... H01R 13/44

[52] U.S. Cl. ..... 439/141; 439/140

[58] Field of Search ..... 439/135–138, 439/141, 147, 140, 134, 149

[56] References Cited

U.S. PATENT DOCUMENTS

| | | | |
|---|---|---|---|
| 2,458,153 | 1/1949 | Festge | 439/141 |
| 3,631,320 | 12/1971 | Eckert | 439/141 |
| 3,763,457 | 10/1973 | Whippo | 439/141 |
| 4,060,297 | 11/1977 | Marshall et al. | 439/147 |
| 4,391,481 | 7/1983 | Golden | 439/141 |
| 4,810,199 | 3/1989 | Kav | 439/141 |

*Primary Examiner*—Larry I. Schwartz
*Assistant Examiner*—Hien D. Vu
*Attorney, Agent, or Firm*—Gerard F. Dunne

[57] ABSTRACT

A safety shield for an electric plug includes a plate member adapted to be held secure against the base of the electric plug with the prongs of the plug extending through complementary openings in the plate member. The plate member carries rotatably a flexible cage member surrounding the prongs of the electric plug, and the cage member is collapsible. In this way as the prongs are inserted into the electric outlet, the cage will collapse to permit insertion, and as the plug is withdrawn from the electric outlet, the cage member will return to its original shape to guard against inadvertent contact with the electrical prongs. The cage member includes a bar element which in one position of the cage member will lie across the tips of the prongs to prevent insertion into an electric outlet, and the cage member can be rotated to position the bar element between the prongs of the plug to enable the plug to be inserted into an electric outlet.

7 Claims, 4 Drawing Sheets

SAFETY SHHIELD FOR AN ELECTRIC PLUG

FIELD OF THE INVENTION

The present invention relates to the child-proofing of an electric plug, and guards against inadvertent contact with the prongs of the electric plug while insertion or withdrawal of the plug from the electric outlet, and also guards against unauthorized use of the plug by a child.

BACKGROUND OF THE INVENTION

Several proposals have been made for child-proofing of electric plugs, and as shown in U.S. Pat. No. 3,763,457 and U.S. Pat. No. 4,391,481, guards have been proposed which extend around the prongs of an electrical plug. These guards can be collapsed while the plug is inserted into a wall outlet. Such collapsible guards are resiliently flexible, and upon withdrawal of the plug from the wall outlet, the guard can return to its initial shape. In this way, the guard protects against inadvertent contact with the prongs of the plug while inserting or withdrawing from the wall outlet. Additionally, guards have been proposed as described in U.S. Pat. No. 4,060,297 which prevent use of electric plug, and removal of the guard is made difficult in order to protect against inadvertent use of the plug by a child.

In order to provide more complete safety in a household with small children, it is necessary that a safety device for an electrical plug not only shield against inadvertent contact with the electrical prongs during insertion or removal of the plug from a wall outlet, but also prevent unauthorized use of the plug by a small child. Therefore, an object of the present invention is to provide an inexpensive safety shield for an electric plug which will not only guard against inadvertent contact of the electrical prongs during insertion or removal from a wall outlet, but will also disable the plug to prevent small children from even attempting to insert the electric plug into a wall outlet.

SUMMARY OF THE INVENTION

According to the present invention, a safety shield is provided for an electric plug of the type having a base with at least two prongs extending therefrom and adapted to be inserted into an electric outlet. The shield includes a plate member adapted to be held against the base of the plug, and the plate member has openings for receiving the prongs of the plug. Additionally, means including a flexible cage member held rotatably to the plate member are provided for surrounding the prongs to guard against inadvertent contact while inserting or removing the plug from an electric outlet. The cage member carries guard means adapted to be spaced from the ends of the prongs for preventing insertion of the prongs of the plug into a wall outlet in one position of the cage member, and upon rotation of the cage member, the guard means are positioned to allow insertion of the prongs into an electric outlet.

Preferably, the cage member has its side portions formed by resilient arms adapted to flex in a manner collapsing the cage member as the plug is inserted into the electric outlet. In this way, the resilient arms may return to their initial position as the plug is withdrawn from the electric outlet to restore the cage member to its full protective state. The guard means preferably includes a bar element adapted to lie across the ends of the prongs of the plug in the one position of the cage member, and this bar element can be positioned to lie between the prongs by rotation of the cage member to enable insertion of the plug into the electric outlet. Preferably, structures are provided to inhibit rotation of the cage member in order to further child-proof the safety shield.

These and other objects, features and advantages of the present invention will become more apparent from the descriptions below of preferred embodiments, these descriptions being made in connection with the following drawings:

DESCRIPTION OF PREFERRED EMBODIMENTS

Figure 1:
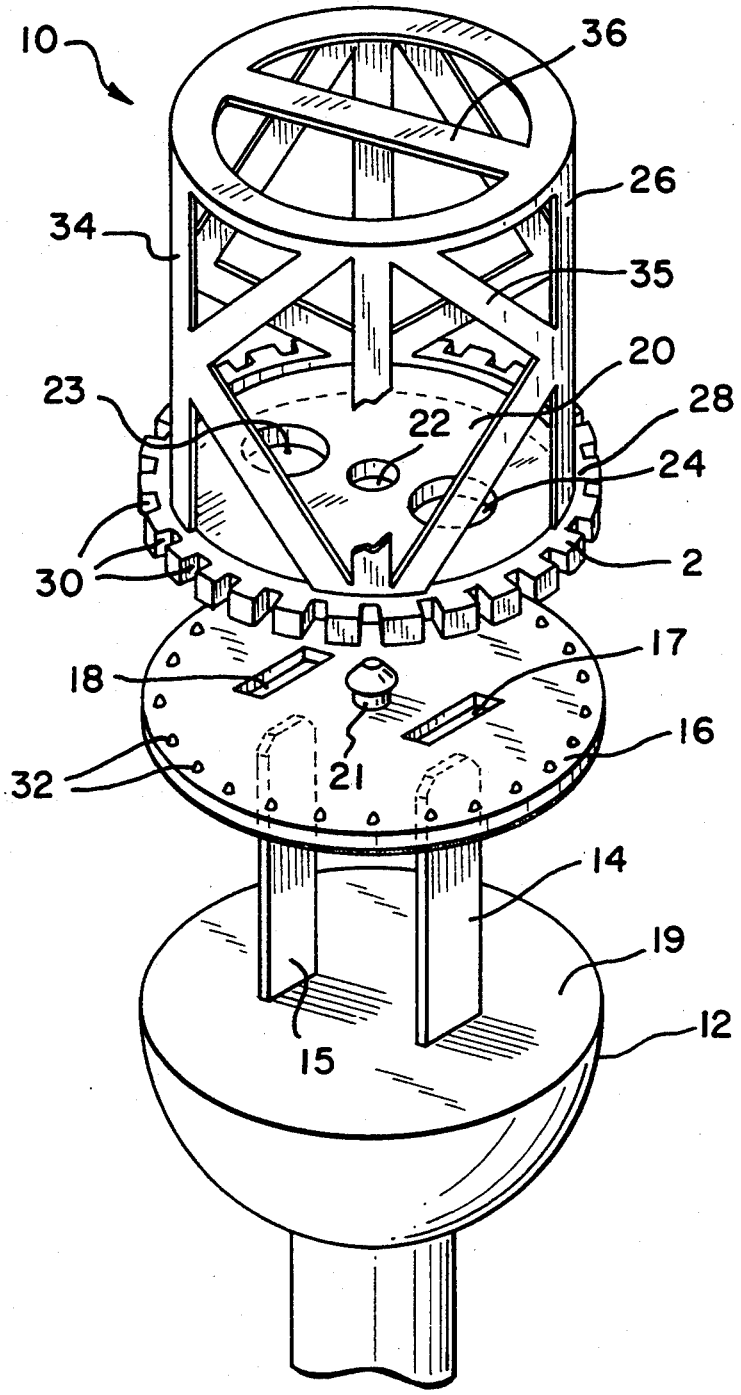
FIG. 1 is an exploded perspective view of one embodiment of the present invention.

As illustrated in FIG. 1, a safety shield 10 is provided for use with electrical plug 12 having two prongs 14 and 15. The safety shield 10 of the embodiment illustrated in FIG. 1 includes a plate member 16 having openings 17 and 18 complementary with the prongs 14 and 15. The underside of the plate member 16 is coated with a suitable adhesive so that upon pressing the plate member 16 against the base 19 of the plug 12, the shield 10 of the present invention may be held firmly and securely to the electric plug.

A plate portion 20 is fitted over the plate member 16, and upstanding post 21 of the plate member 16 fits within mating opening 22 of the plate portion 20 to serve as a fastener to secure to the two plates together. Plate portion 20 has openings 23 and 24 to receive the prongs 14 and 15 of the electric plug.

Figure 4:
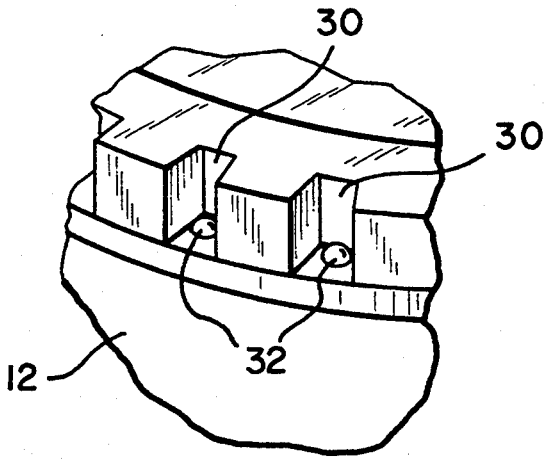
FIG. 4 is a detailed view of a portion of FIG. 1.

Secured rotatably to the plate portion 20 of FIG. 1 is a cage member 26. Cage member 26 has a rim portion 28 which is secured rotatably to plate portion 20 by suitable tongue and groove structures such as those illustrated in detail in FIG. 6 for the embodiment of FIG. 5. The rim 28 of the cage member 26 has formed therein radial slots 30 which are adapted to receive upstanding nubs 32 formed circumferencially around the lower plate member 16, as shown in detail in FIG. 4. Nubs 32 fitting within the slots 30 inhibit rotation of the cage member 26, but due to the resilient deformation of the nubs 32, the cage can be forcibly rotated as desired. By these structures, rotation of the cage member in inhibited in order to make it difficult for a small child to rotate the cage member to provide an important safety feature as will be set forth more fully below.

Figure 3:
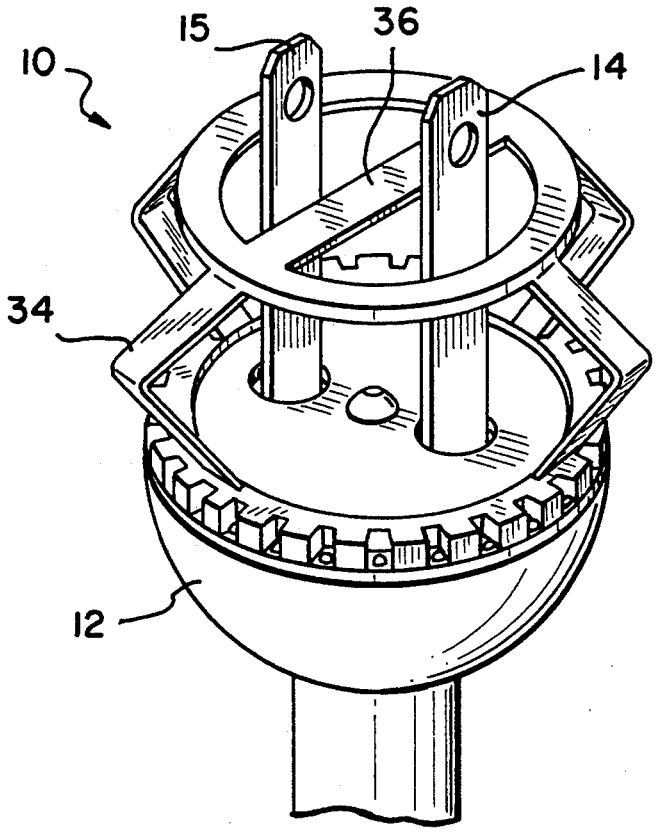
FIG. 3 illustrates the collapsing of a cage member upon assertion of the electrical plug.

The cage member 26 is formed of resilient arms 34 and may have cross members 35, and as can be shown in FIG. 3, the cage member 26 may readily be flexed to collapse the cage around the upstanding prongs 14 and 15 of the electric plug. The upper portion of the cage member 26 is open with a bar element 36 extending centrally across the opening. As illustrated in FIG. 1, the cage member 26 can be rotated into a position whereby the bar element 36 would lie across the forward tips of the prongs 14 and 15 of the electric plug 12.

In this way, any attempt to insert the electric plug carrying the safety shield of the present into an electric wall outlet would be frustrated by the prongs abutting against the bar element 36 serving as a guard means to prevent entry into the wall outlet. However, the cage member 26 can be rotated approximately 90° to position bar element 36 so as to lie between the electric prongs 14 and 15. The electric plug can then be inserted into an electric wall outlet as shown in FIG. 3, by positioning the bar element 36 between the electric prongs 14 and 15 so they can extend through the opening in the cage member 26 while the cage member collapses upon inserting the electric plug into a wall unit.

The elements of the safety shield 10 are made from a synthetic plastics material having suitable resiliency so that as the electric plug is withdrawn from an electric outlet, the resilient cage member will be restored to its initial position. Consequently, while the electric outlet is being inserted or withdrawn from an electric outlet the cage member 10 will extend around the exposed portions of the electric prongs 14 and 15 to guard against any inadvertent contact and electrical shock hazard.

A safety shield for electric plugs has, therefore, been provided which not only can prevent insertion of the electric plug into a wall outlet by a small child, but even if the safety shield is properly orientated to permit insertion of the plug into the wall outlet, protection is provided against inadvertent contact with exposed portions of the electrical prongs of the plug.

Figure 2:
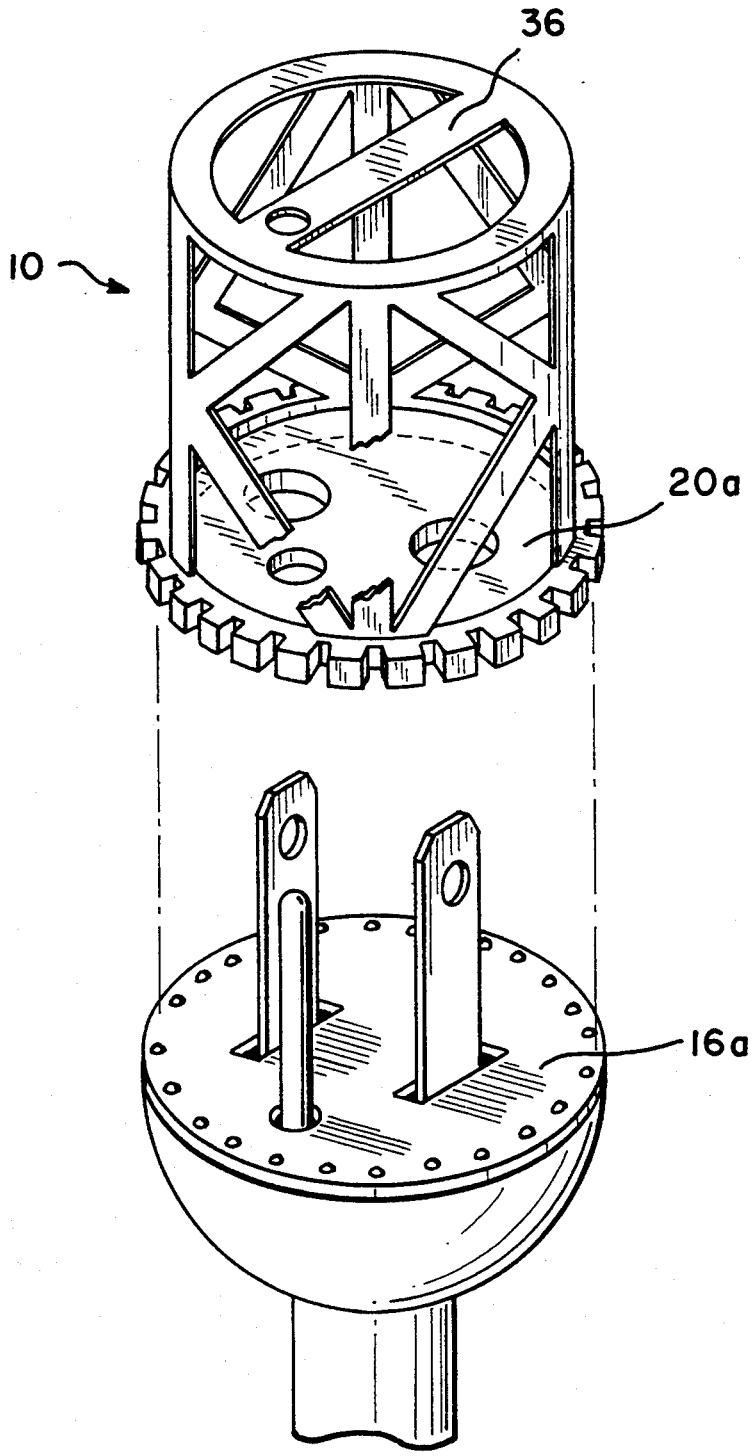
FIG. 2 is an exploded perspective of another embodiment of the present invention.

FIG. 2 illustrates an modification of the embodiment of FIG. 1 which is suitable for use with those types of plugs which have either two or three electrical prongs, and as illustrated, the two plate members 16*a* and 20*a* have openings to receive three prongs, and of course this modification can be used with electric plugs having either two or three prongs.

Figure 6:
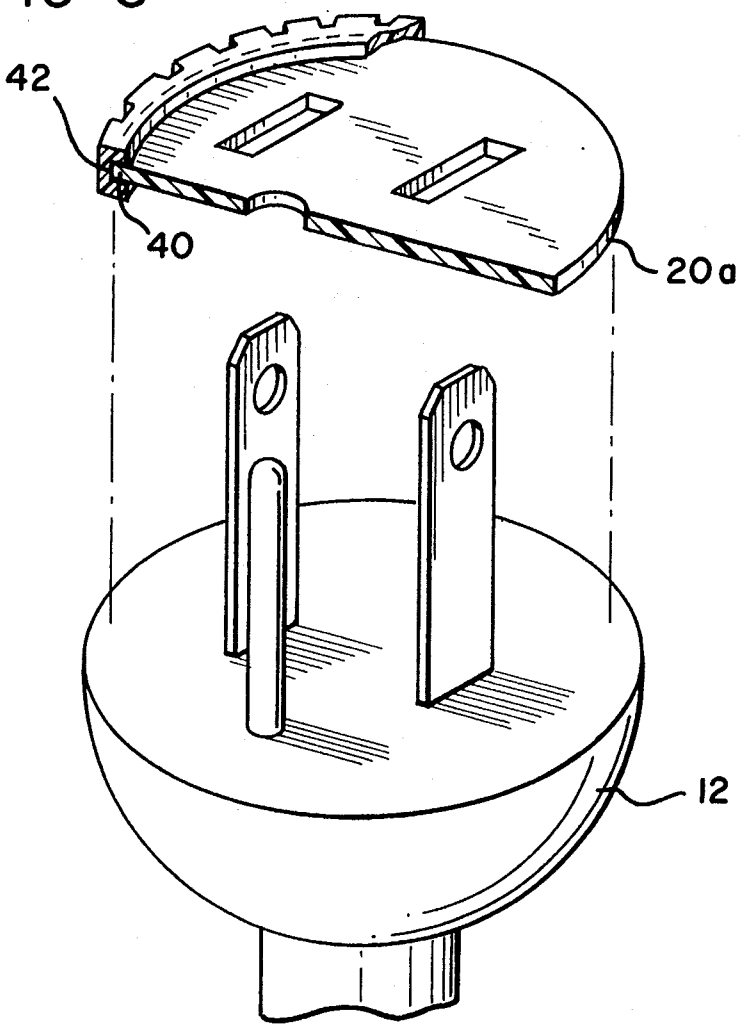
FIG. 6 is a detailed view thereof.
Figure 5:
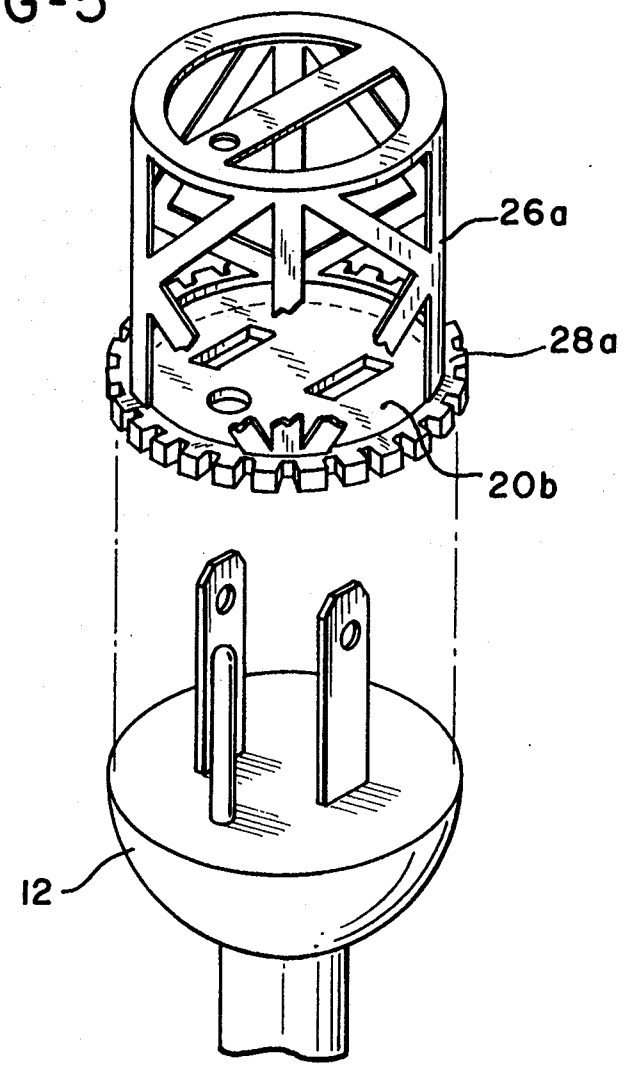
FIG. 5 is a perspective view of another embodiment of the present invention.

FIG. 5 illustrates an embodiment of the present invention which includes only a single plate member, and as illustrated, plate member 20*b* includes complementary openings to receive the prongs of an electrical plug 12, and has a cage member 26*a* formed integrally with a rim portion 28*a* fitted to the single plate member 20*b*. The rim portion 28*a* is held to the plate member 20*b* by suitable structures holding two elements together while permitting relative rotation, and as illustrated in FIG. 6, rim portion 28*a* may include a tongue structure 40 which slides within a complementary groove 42 formed the inner wall portion of the rim 28*a*. If desired, the relative rotation of the plate member 20*a* and the rim 28*a* can be made child-proof by suitable structures preventing relative rotation unless certain portions of the rim are squeezed or pressed downward or by other mechanical means well known to the art.

The present invention has been described with reference to the details of several embodiments, but it is understood that the scope of the present invention is defined not by the descriptions above, but by the claims appended hereto.

I claim:

1. A safety shield for an electric plug having a base with at least two prongs extending therefrom so as to be inserted into an electric outlet, said shield including a plate member adapted to be held against the base of said plug and having openings for receiving said prongs, and means including a flexible cage held rotatably to said plate member for surrounding the prongs to guard against inadvertent contact therewith while inserting or removing the plug from an electric outlet, said cage member carrying guard means adapted to be spaced from the ends of said prongs for preventing insertion of the prongs of the plug into an electric outlet in one position of said cage and, upon rotation of said cage member, permitting the prongs of the plug to be inserted into an electric outlet.

2. A safety shield as set forth in claim 1, said cage member having side portions formed by resilient arms adapted to flex to collapse said cage member when the electric plug is inserted into an electric outlet, and to restore the cage member to its extended position upon withdrawal of the plug from the electric outlet.

3. A safety shield as set forth in claim 2, said guard means including a bar element adapted to lie across the ends of the prongs in said one position and to be rotated to lie between the prongs for insertion of the plug into an outlet.

4. A safety shield as set forth in claim 1, said guard means including a bar element adapted to lie across the ends of the prongs in said one position and to be rotated to lie between the prongs for insertion of the plug into an outlet.

5. A safety shield as set forth in claim 1, said plate member carrying on its underside an adhesive to secure it firmly to the base of said plug.

6. A safety shield as set forth claim 1, said cage member having a plate portion adapted to overlie said plate member and having openings for receiving the prongs of the electric plug, said cage member having rim portion extending rotatably around said plate portion and having radial slots adapted to overlie hubs of said plate member to provide a locking structure to inhibit rotation of said cage member.

7. A safety shield for an electric plug having a base with at least two prongs extending therefrom so as to be inserted into an electric outlet, said shield including a plate member adapted to be held against the base of said plug and having openings for receiving said prongs, and means including a flexible cage held rotatably to said plate member for surrounding the prongs to guard against inadvertent contact therewith while inserting or removing the plug from an electric outlet, said cage member carrying guard means adapted to be spaced from the ends of said prongs for preventing insertion of the prongs of the plug into an electric outlet in one position of said cage and, upon rotation of said cage member, permitting the prongs of the plug to be inserted into an electric outlet, including means for holding said cage member against unauthorized rotation.

* * * * *